United States Patent [19]

Samis et al.

[11] 4,250,023

[45] Feb. 10, 1981

[54] METHOD AND SYSTEM FOR SLURRYING FIBROUS ORGANIC MATERIALS AND REMOVING GRIT THEREFROM

[75] Inventors: James M. Samis, Oklahoma City; Walter C. Waechter, Edmond, both of Okla.

[73] Assignee: Thermonetics, Inc., Oklahoma City, Okla.

[21] Appl. No.: 59,490

[22] Filed: Jul. 20, 1979

[51] Int. Cl.[3] ..... B03B 7/00

[52] U.S. Cl. ..... 209/3; 209/10; 209/17; 209/211; 241/24

[58] Field of Search ..... 209/3, 10, 11, 17, 18, 209/44, 208, 211, 461, 463, 465; 241/24

[56] References Cited

U.S. PATENT DOCUMENTS

| | | | |
|---|---|---|---|
| 3,037,624 | 6/1962 | Jackson et al. | 209/3 X |
| 3,493,108 | 2/1970 | Martinez | 209/3 |
| 3,838,199 | 9/1974 | Coe et al. | 426/55 |
| 3,973,043 | 8/1976 | Lynn | 426/55 |
| 4,022,231 | 5/1977 | Kostiainen et al. | 210/10 X |

*Primary Examiner*—William A. Cuchlinski, Jr.
*Attorney, Agent, or Firm*—C. Clark Dougherty, Jr.

[57] ABSTRACT

A method of slurrying fibrous organic materials containing grit and removing grit therefrom is provided comprising the steps of particulating the fibrous organic materials, combining the particulated fibrous organic materials with a liquid to form a slurry of suspendable grit and materials contained therein, separating non-suspendable grit and materials from the slurry and then separating suspended grit contained in the slurry therefrom. A system for carrying out the method of the invention is also provided.

23 Claims, 1 Drawing Figure

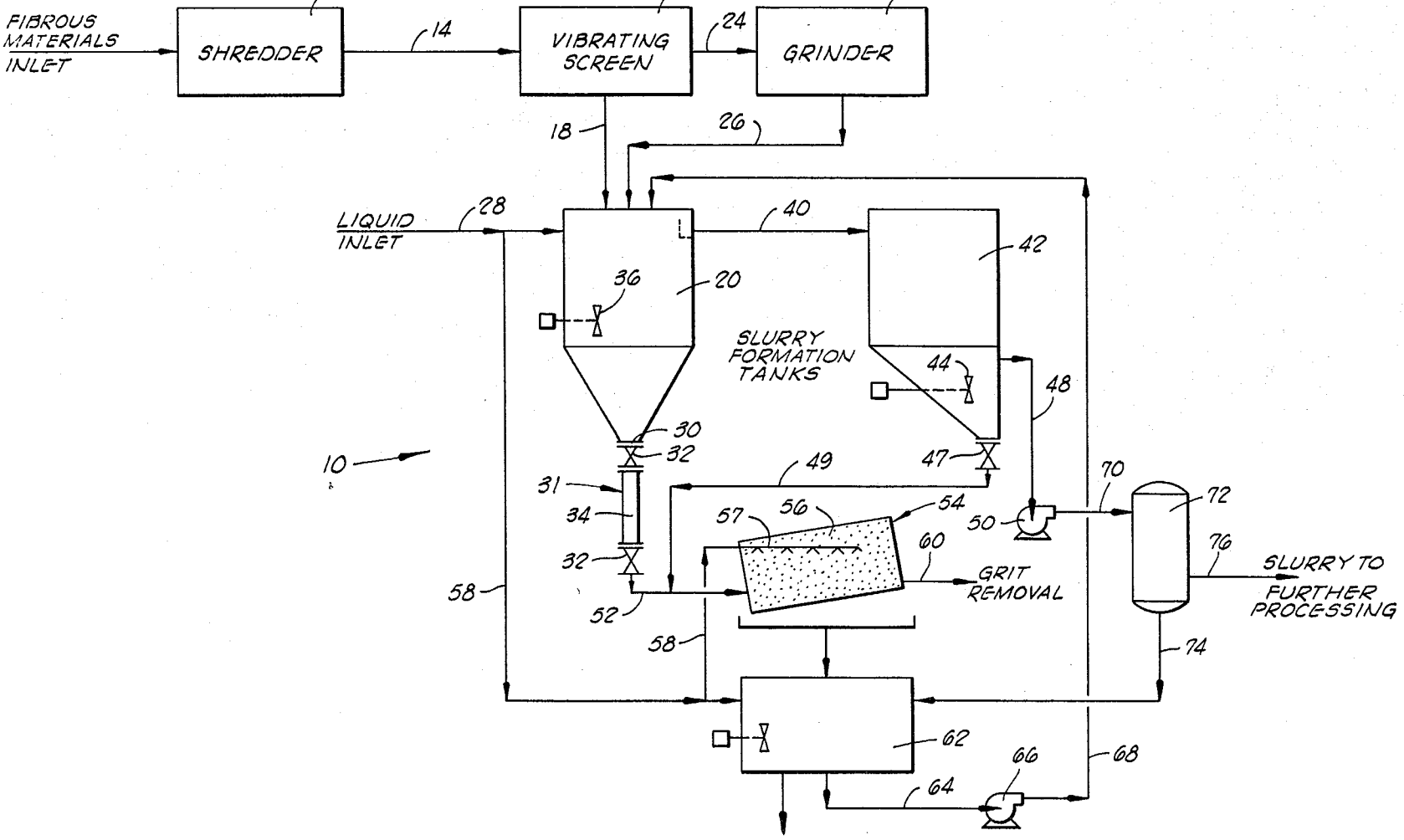
FIBROUS MATERIALS INLET
SHREDDER
VIBRATING SCREEN
GRINDER
LIQUID INLET
SLURRY FORMATION TANKS
GRIT REMOVAL
SLURRY TO FURTHER PROCESSING
10
12
14
16
18
20
22
24
26
28
30
31
32
34
36
40
42
44
47
48
49
50
52
54
56
57
58
60
62
64
66
68
70
72
74
76

METHOD AND SYSTEM FOR SLURRYING FIBROUS ORGANIC MATERIALS AND REMOVING GRIT THEREFROM

BACKGROUND OF THE INVENTION

1. Field of the Invention

The present invention relates generally to a method and system for slurrying fibrous organic materials and removing grit therefrom, and more particularly, but not by way of limitation, to a method and system for slurrying fibrous organic materials such as feedlot fecal waste materials with water and removing grit therefrom.

2. Description of the Prior Art

Various processes and apparatus for converting fermentable fibrous organic materials such as feedlot fecal wastes, e.g., cattle manure, into more valuable and useful products have been developed. For example, a process for converting fermentable fibrous organic materials to useful products is disclosed in our co-pending application Ser. No. 39,026 filed May 14, 1979. Other processes wherein fermentable fibrous organic materials are converted to useful products such as methane gas and protein-rich animal feed supplement are disclosed in U.S. Pat. Nos. 3,838,199 and 3,973,043.

In all of such processes, the fibrous organic materials are combined with a carrier liquid, e.g., water, to form a slurry thereof and the slurry subjected to a fermentation process or processes to produce a protein-rich and hydrocarbon vapor products. The formation of a slurry of fibrous organic materials such as feedlot fecal waste materials is difficult, particularly where the slurry formation must be carried out on a continuous basis. The waste materials usually contain grit, i.e., relatively heavy impurities, such as sand, soil, rocks and other insoluble materials and the organic portions of the waste materials are generally extremely dry and hard. If the waste materials are inadequately suspended in the carrier liquid problems in treating the resulting slurry are encountered such as the plugging off of conduits, inadequate and/or inefficient fermentation, etc. If the grit contained in the waste materials is not removed or inadequately removed, the same problems result as well as requiring clean-out and rework of process apparatus on a continuous basis.

By the present invention an improved method and system for slurrying fibrous organic materials containing grit and removing the grit therefrom is provided which obviates the problems mentioned above.

SUMMARY OF THE INVENTION

A method of slurrying fibrous organic materials containing grit and removing grit therefrom comprising particulating the materials, combining the particulated materials with a liquid to form a slurry of suspendable grit and materials contained therein, separating non-suspendable grit and materials contained in the particulated materials from the slurry and separating suspended grit contained in the slurry therefrom. A system for carrying out the method of the invention is also provided.

It is, therefore, a general object of the present invention to provide a method and system for slurrying fibrous organic materials and removing grit therefrom.

A further object of the present invention is the provision of a method and system for continuously slurrying fibrous organic materials containing grit, such as feedlot fecal waste materials, and removing the grit therefrom.

Other and further objects, features and advantages of the invention will be readily apparent to those skilled in the art upon a reading of the description of preferred embodiments which follows when taken in conjunction with the accompanying drawing.

BRIEF DESCRIPTION OF THE DRAWING

In the drawing forming a part of this disclosure a system for carrying out the method of the present invention is illustrated diagrammatically.

DESCRIPTION OF PREFERRED EMBODIMENTS

Referring now to the drawing, a system of the present invention is illustrated and generally designated by the numeral 10. The system 10 includes a shredder 12 for shredding and particulating fibrous organic materials containing grit. The term "grit" is used herein to mean sand, soil, stones, rocks and other relatively heavy insoluble inpurities contained in the fibrous organic materials. The shredder 12 can be of various conventional types and designs which function to shred and particulate the incoming fibrous organic materials on a continuous basis. When the system 10 is utilized to slurry fecal waste materials such as cattle manure, the shredder 12 is preferably of a design the same as or similar to a conventional manure spreader whereby the fecal waste materials are shredded and particulated continuously.

A conveyor 14 leads the shredded and particulated fibrous organic materials to a conventional vibrating screen 16 wherein the materials are separated into a first portion of a desired size and smaller and a second portion of materials larger than the desired size. Generally, the portion of materials of desired size and smaller are of a size which pass through about a 1 mesh screen (U.S. Sieve Series). This portion of the materials is led by a conveyor 18 or otherwise conducted to the inlet of a slurry formation and gravity separation tank 20. The portion of the shredded materials of particle size greater than that which passes through a 1 mesh screen is conducted to a second shredder or grinder 22 by a conveyor 24. The grinder 22 can be of a conventional design, such as a hammer mill, and functions to reduce the portion of shredded materials of larger than desired size to the desired size and smaller. A conveyor 26, or other means, conducts the materials reduced in size by the grinder 22 to the inlet of the slurry formation tank 20.

A carrier liquid with which the fibrous organic materials are to be slurried is continously conducted to the tank 20 by a conduit 28 connected thereto. The tank 20 is preferably of cylindrical shape and includes a cone-shaped bottom having a non-suspended grit and materials outlet connection 30 at the apex thereof. A trap 31 comprised of a pair of shutoff valves 32 separated by a length of conduit 34 is connected to the connection 30 of the tank 20 for accumulating non-suspended grit and materials removed from the tank 20. The tank 20 includes a power driven mixer 36 positioned therewithin for agitating the liquid and particulated materials entering the tank 20. A spillover outlet is provided near the top of the tank 20 and a conduit 40 is connected thereto and to an inlet connection of a mixing tank 42. The mixing tank 42 includes a power driven mixer 44 positioned near the bottom thereof, and preferably, as shown in the drawing, the tank 42 includes a sloped bottom with a slurry outlet connection positioned above the lowest point thereof. A conduit 48 is connected between the slurry outlet connection of the mixing tank 42 and the suction connection of a pump 50. A grit outlet connection 46 is provided at the lowest point of the tank 42 and a shut-off valve 47 is connected thereto.

A conduit 52 is connected to the non-suspended grit and materials 31 which leads non-suspended grit and materials to a conventional trommel screen apparatus 54. A conduit 49 is connected between the shut-off valve 47 and the conduit 52 for leading nonsuspended grit and materials from the mixing tank 42 to the trommel screen 54.

The trommel screen apparatus 54 is of conventional design and includes an inclined rotating cylindrical screen 56, preferably of a size of about 4 mesh (U.S. Sieve Series) into which non-suspended grit and materials from the tanks 20 and 42 are periodically injected by the conduit 52. The trommel screen apparatus 54 includes a liquid spray nozzle assembly 57 disposed within the screen 56 connected to a source of liquid by a conduit 58. In operation of the trommel screen apparatus, grit and materials entering the interior of the screen 56 are further particulated and combined with liquid. The heavier materials which cannot be further particulated, including non-suspendable grit exits the screen 56 by way of the inclined end thereof and is conveyed to a grit disposal area by a conveyor 60 or other suitable means. Particulated materials passing through the screen 56 are slurried with liquid in an accumulator 62 and the slurry is withdrawn therefrom by way of a conduit 64 connected to the suction connection of a pump 66. The discharge connection of the pump 66 is connected by a conduit 68 to an inlet connection of the tank 20. The accumulator 62 includes a power driven mixer 65 which stirs the slurry in the accumulator 62 and removes lumps therefrom.

The slurry withdrawn from the mixing tank 42 and pumped by the pump 50 is conducted by a conduit 70 attached to the pump 50 to a conventional cyclone separator apparatus 72. While passing through the cyclone separator 72, suspended grit is separated from the slurry and removed from the cyclone separator 72 by a conduit or conveyor 74 which leads the grit to the accumulator 62 from where it is removed by way of a conduit or conveyor 78 connected thereto. The resulting slurry, substantially free of grit, and having suspended organic materials therein is conducted from the cyclone separator 72 by a conduit 76 connected thereto to further processing facilities.

Operation of the System 10

In operation of the system 10 for carrying out the method of this invention, fibrous organic materials such as feedlot fecal waste materials are continuously supplied to the shredder 12 wherein they are shredded and particulated. The shredded and particulated materials are conveyed to the vibrating screen 16 wherein the particles of desired size and smaller are separated from the larger particles and passed to the slurry formation and gravity separation tank by way of the conveyor 18 or other means. The larger size particles are conveyed from the vibrating screen 16 to a grinder 22 wherein they are reduced in size to particles of desired size or smaller which are conveyed to the tank 20 by way of conveyor 26 or other means. Generally, the shredded and particulated fibrous materials entering the slurry formation tank 20 are of a size in the range of that which passes through a 4 mesh screen (U.S. Seive Series).

Liquid with which the shredded and particulated materials are to be slurried is continuously conducted to the tank 20 by way of the conduit 28 connected thereto at a rate proportional to the rate of solid materials entering the tank 20 and the resulting mixture is agitated by the mixer 36. The tank 20 is of a size such that the slurry formed within the tank 20 is retained therein for a period of time sufficient for heavier non-suspendable grit and materials entering the tank 20 to settle and accumulate in the conical shaped bottom thereof. Slurry containing suspendable grit and materials is removed from the tank 20 by way of the conduit 40 attached thereto and is conducted to the mixing tank 42.

The non-suspendable grit and materials accumulating in the bottom of the tank 20 are periodically removed therefrom by first opening the uppermost valve 32 which allows the materials to enter the trap 33. The uppermost valve 32 is then closed and the lowermost valve 32 opened whereby the materials within the trap 33 are conducted to the trommel screen apparatus 54. While within the rotating inclined cylindrical screen 56 of the trommel screen apparatus, the non-suspendable grit and materials are particulated and combined with liquid which enters the interior of the screen by way of the spray nozzle assembly 57 and conduit 58 connected thereto. Heavier grit such as pebbles, rocks, etc., are removed from the forward end of the screen 56 by way of the conveyor 60 and the particulated materials passing through the screen 56 are slurried with liquid and accumulate in the accumulator 62. From the accumulator 62 the slurry is withdrawn by way of the conduit 64, the pump 66 and the conduit 68 and conducted to the mixing tank 20. While passing through the mixing tank 42, the slurry from the tank 20 is agitated to further suspend organic material and grit contained therein. The slurry is conducted by way of the conduit 48, the pump 50 and the conduit 70 to the cyclone separator 72 wherein the slurry is subjected to centrifugal separation whereby the heavier suspended grit is separated and removed from the slurry. The resulting relatively grit-free slurry containing suspended organic materials is conducted from the cyclone separator 72 by way of the conduit 76 to further processing facilities such as a fermentation chamber wherein the organic materials are converted to salable products.

In order to further illustrate the method and system of the present invention, the following example is given.

EXAMPLE 41,650 lbs/hr of cattle manure are conducted to the shredder 12 wherein the manure is initially shredded and particulated. From the shredder 12 the shredded and particulated manure is conducted to the vibrating screen apparatus 16 by the conveyor 14. 10,400 lbs/hr of shredded and particulated grit and organic materials of a size such that passes through a size 1 mesh screen are conducted to the slurry formation tank 20 by way of the conveyor 18. 31,250 lbs/hr of shredded and particulated material of a size greater than that which passes through a 1 mesh screen is conducted by the conveyor 24 to the grinder 22 wherein such materials are reduced in size to that which passes through a 4 mesh screen and conducted to the tank 20 by the conveyor 26. 22,350 gals/hr of water enter the tank 20 by way of conduit 28 connected thereto and the resulting mixture of water and particulated wastes and grit are retained in the tank 20 for about 20 minutes while being agitated by the mixer 36. 2,150 lbs/hr of non-suspendable grit and materials gravitate to the bottom of the tank 20 which are periodically removed therefrom and conducted to the trommel screen apparatus 54. 230,100 lbs/hr of slurry containing suspended grit and waste materials flows from the tank 20 by way of the conduit 40 to the mixing tank 42. Of the 2,150 lbs/hr of non-suspendable grit and materials entering the trommel screen apparatus 54, 550 lbs/hr of grit and other non-suspendable materials are removed by way of the conveyor 60. 2,500 lbs/hr of water are injected into the trommel screen apparatus 54 and 1,600 lbs/hr of grit and organic materials which are further particulated while within the trommel screen apparatus 54 pass through the screen 56 and into the accumulator 62. 4,100 lbs/hr of slurry are removed from the accumulator 64 and conducted to the mixing tank 20 by way of the conduits 64 and 68 and pump 66. A total of 230,100 lbs/hr of slurry enters the mixing tank 42 and is retained therein for approximately 10 minutes during which time the combined slurry is agitated. The resulting slurry containing suspended grit and waste materials is conducted by way of the conduits 48 and 70 and pump 50 to the cyclone separator 72 wherein 2,350 lbs/hr of grit are separated from the slurry and removed from the separator by way of the conduit 74. A 227,750 lbs/hr stream of substantially grit-free slurry containing suspended waste materials is removed from the cyclone separator 72 by the conduit 76 from where it is conducted to further processing facilities.

As will now be apparent, the method and system of the present invention achieves the particulating of incoming fibrous organic materials such as feedlot fecal wastes in a manner whereby most of the materials are reduced in size to that which is readily suspendable in a liquid carrier. The relatively small amount of grit and other material which is not particulated to a readily suspendable size is separated from the slurry in the initial slurry formation step. Such separated non-suspendable materials are further processed to remove at least a portion of the large size heavy grit therefrom and to particulate the other materials and slurry them with additional liquid. The two slurry streams thus produced are combined to form a slurry of suspended grit and organic materials followed by the removal of substantially all the suspended grit contained in the slurry. Thus, the method of the present invention achieves the slurrying of fibrous organic materials in an efficient manner whereby waste of non-suspendable organic materials is minimized and substantially all of the grit and other relatively heavy insoluble impurities removed therefrom. Thus, the present invention is well adapted to carry out the objects and achieve the ends and advantages mentioned as well as those inherent therein. While numerous changes in the arrangement and construction of steps and components of the invention will readily suggest themselves to those skilled in the art, such changes are encompassed within the spirit of this invention as defined by the appended claims.

What is claimed is:

1. A method of slurrying fibrous organic materials containing grit and removing grit therefrom comprising:
(a) particulating said materials;
(b) combining said particulated materials with a liquid to form a slurry of suspendable grit and materials contained therein;
(c) separating non-suspendable grit and materials contained in said particulated materials from said slurry; and
(d) separating suspended grit contained in said slurry therefrom.

2. The method of claim 1 which is further characterized to include the steps of:
(e) particulating said separated non-suspendable grit and materials a second time; and
(f) combining said particulated grit and materials with a liquid to form additional slurry of suspendable grit and materials contained therein.

3. The method of claim 2 wherein said additional slurry formed in step (f) is combined with the slurry formed in step (b).

4. A method of slurrying fibrous organic materials containing grit and removing grit therefrom comprising:
(a) initially particulating said organic materials;
(b) combining said initially particulated materials with a liquid to form a slurry of suspendable grit and materials contained in said particulated materials;
(c) separating non-suspendable grit and materials contained in said particulated materials from said slurry;
(d) particulating said separated non-suspendable grit and materials a second time;
(e) combining said particulated grit and materials from step (d) with a liquid to form an additional slurry of suspendable grit and materials contained therein;
(f) separating non-suspendable grit and materials from said additional slurry formed in step (e);
(g) combining said slurries formed in steps (b) and (e); and
(h) separating suspended grit contained in said combined slurries therefrom.

5. The method of claim 4 wherein the step of initially particulating said fibrous organic materials comprises the steps of:
shredding said organic materials;
separating particles contained in said shredded organic materials of a desired size and smaller from larger size particles; and
grinding said larger size particles whereby said particles are reduced to particles of smaller size.

6. The method of claim 5 wherein the step of separating suspended grit contained in said combined slurries comprises subjecting said slurries to centrifugal separation whereby said grit is removed therefrom.

7. A method of slurrying fibrous waste materials containing grit and removing grit therefrom comprising:
(a) shredding said waste materials;
(b) combining said shredded waste materials with water in a mixing tank to form a slurry of suspendable materials contained in said shredded waste materials;
(c) retaining said combined waste materials and water in said mixing tank for a period of time sufficint for non-suspendable grit and materials contained in said shredded waste materials to gravitate to the bottom of said tank;
(d) removing said non-suspendable grit and materials from said tank;
(e) conducting said removed non-suspendable grit materials to a trommel screen having water injected therein whereby at least a portion of said grit is removed from said materials, said materials are particulated and additional slurry of suspendable materials is formed;

(f) withdrawing said slurry from said mixing tank;

(g) combining the slurry withdrawn from said mixing tank with the slurry formed in said trommel screen; and (h) subjecting said combined slurries to centrifugal separation to remove suspended grit therefrom.

8. The method of claim 7 wherein step (a) comprises:

initially shredding said fibrous waste materials;

separating particles contained in said initially shredded waste materials of a desired size and smaller from larger size particles contained therein; and grinding said separated larger size particles whereby such particles are reduced to particles of smaller size.

9. The method of claim 8 wherein step (g) comprises conducting the slurry withdrawn from said mixing tank and the slurry formed in said trommel screen to a second mixing tank wherein said slurries are combined prior to subjecting said combined slurry to centrifugal separation.

10. The method of claim 9 wherein said slurries are continuously agitated while in said mixing tanks.

11. A method of slurrying fibrous feedlot fecal waste materials containing grit and removing grit therefrom comprising:

(a) shredding said fibrous waste materials;

(b) combining said shredded waste materials with water in a first mixing tank to form a slurry of suspendable grit and organic materials contained therein;

(c) retaining said combined shredded waste materials and water in said first mixing tank for a period of time sufficient for non-suspendable grit and materials contained in said shredded waste materials to gravitate to the bottom of said tank;

(d) withdrawing said slurry formed in said first mixing tank therefrom;

(e) removing said non-suspendable grit and materials from said tank;

(f) conducting said non-suspendable grit and materials removed from said first mixing tank to a trommel screen having water injected therein whereby at least a portion of said grit is removed from said nonsuspendable grit and materials, said materials are particulated and additional slurry is formed therefrom;

(g) combining said additional slurry formed in said trommel screen with the slurry withdrawn from said first mixing tank in a second mixing tank;

(h) withdrawing said combined slurry from said second mixing tank; and (i) subjecting said combined slurry to centrifugal separation whereby suspended grit is removed therefrom.

12. The method of claim 11 wherein step (a) comprises:

initially shredding said fibrous waste materials;

separating particles contained in said shredded waste materials of a desired size and smaller from larger size particles contained therein; and grinding said larger size particles whereby said particles are reduced to particles of smaller size.

13. The method of claim 12 wherein said slurries are continuously agitated in said first and second mixing tanks.

14. A system for slurrying fibrous organic materials containing grit and removing grit therefrom comprising:

(a) means for shredding said fibrous organic materials;

(b) a slurry formation and gravity separation tank having a shredded fibrous organic materials inlet, a liquid inlet, a slurry outlet, and a non-suspended grit and materials outlet;

(c) means for conducting shredded fibrous organic materials connected between said means for shredding fibrous organic materials and said tank;

(d) means for separating suspended grit from a slurry containing suspended fibrous organic materials and grit having a slurry inlet, a slurry outlet and a separated grit outlet; and (e) conduit means for conducting slurry connected between said slurry outlet of said tank and said means for separating suspended grit from a slurry containing suspended fibrous organic materials and grit.

15. The system of claim 14 which is further characterized to include:

(f) means for removing at least a portion of the grit from said non-suspendable grit and materials, particulating said materials and forming additional slurry thereof; and (g) conduit means for conducting non-suspendable grit and materials connected between said non-suspendable grit and materials outlet of said tank and said means for removing at least a portion of the grit therefrom, particulating said materials and forming additional slurry thereof.

16. The system of claim 15 which is further characterized to include:

(h) means for combining two slurry streams having a pair of slurry inlets and a combined slurry outlet;

(i) conduit means for conducting slurry connected between said slurry outlet of said tank and one of said slurry inlets of said means for combining two slurry streams;

(j) conduit means for conducting slurry connected between said means for removing at least a portion of the grit from non-suspendable grit and materials, particulating said materials and forming additional slurry thereof and the other of said inlets of said means for combining two slurry streams; and (k) conduit means for conducting combined slurry connected between the outlet of said means for combining two slurry streams and the inlet of said means for separating suspended grit from a slurry containing a suspended fibrous organic materials and grit.

17. The system of claim 16 wherein sad means for combining two slurry streams is comprised of a mixing tank.

18. The system of claim 17 wherein said means for removing at least a portion of the grit from non-suspendable grit and materials, particulating said materials and forming additional slurry thereof is comprised of a trommel screen having a nonsuspendable grit and materials inlet, a liquid inlet, a grit outlet and a slurry outlet.

19. The system of claim 18 wherein said means for separating suspended grit from a slurry containing suspended fibrous organic materials and grit is comprised of a cyclone separator.

20. A system for slurrying fibrous feedlot fecal waste materials containing grit and removing grit therefrom comprising:

(a) means for shredding said fibrous waste materials;

(b) a slurry formation and gravity separation tank having a shredded fibrous waste materials inlet, a water inlet, a slurry outlet and a non-suspended grit and materials outlet;

(c) means for conducting shredded waste materials connected between said means for shredding waste materials and said tank;

(d) means for removing at least a portion of the grit from non-suspendable grit and materials, particulating said materials and forming a slurry thereof;

(e) first conduit means for conducting non-suspendable grit and materials connected between said non-suspendable grit and materials outlet of said tank and said means for removing at least a portion of the grit from non-suspendable grit and materials, particulating said materials and forming a slurry thereof;

(f) means for combining two slurry streams having a pair of slurry inlets and a combined slurry outlet;

(g) second conduit means for conducting slurry connected between said slurry outlet of said tank and one of said slurry inlets of said means for combining two slurry streams;

(h) third conduit means for conducting slurry connected between said means for removing at least a portion of the grit from non-suspendable grit and materials, particulating said materials and forming a slurry thereof and the other of said inlets of said means for combining two slurry streams;

(i) means for separating suspended grit from a slurry containing suspended fibrous waste materials and grit having a slurry inlet, a slurry outlet and a separated grit outlet; and (j) fourth conduit means for conducting slurry connected between the outlet of said means for combining two slurry streams and the inlet of said means for separating suspended grit from a slurry containing suspended fibrous waste materials and grit.

21. The system of claim 20 wherein said means for combining two slurry streams is a mixing tank.

22. The system of claim 21 wherein said means for removing at least a portion of the grit from non-suspendable grit and materials, particulating said materials and forming a slurry thereof comprises a trommel screen having a non-suspendable grit and materials inlet, a water inlet, a grit outlet and a slurry outlet.

23. The system of claim 22 wherein said means for separating suspended grit from a slurry containing suspended fibrous organic materials and grit comprises a cyclone separator.

* * * * *